US009995125B2

(12) United States Patent
Madasu et al.

(10) Patent No.: US 9,995,125 B2
(45) Date of Patent: Jun. 12, 2018

(54) FRACTURE NETWORK MODEL FOR SIMULATING TREATMENT OF SUBTERRANEAN FORMATIONS

(71) Applicant: Halliburton Energy Services, Inc., Houston, TX (US)

(72) Inventors: Srinath Madasu, Harris, TX (US); Philip D. Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 240 days.

(21) Appl. No.: 15/075,896

(22) Filed: Mar. 21, 2016

(65) Prior Publication Data

US 2017/0268321 A1 Sep. 21, 2017

(51) Int. Cl.
*E21B 43/267* (2006.01)
*E21B 47/00* (2012.01)

(52) U.S. Cl.
CPC ..... *E21B 43/267* (2013.01); *E21B 47/00* (2013.01)

(58) Field of Classification Search
CPC ..... E21B 43/267; E21B 47/00
See application file for complete search history.

(56) References Cited

U.S. PATENT DOCUMENTS 5,908,267 A * 6/1999 Schuring ..... B09C 1/00 166/308.1
7,210,528 B1 5/2007 Brannon et al.
8,262,909 B2 9/2012 Angelescu et al.
(Continued)

FOREIGN PATENT DOCUMENTS

WO WO-2014171947 A2 10/2014

OTHER PUBLICATIONS

"SIMTech Microfluidics Foundry", [online]. © 2011 Singapore Institute of Manufacturing Technology Retrieved from the Internet: <URL: http://www1.simtech.a-star.edu.sg/smf/customised_chips.htm>, (2011), 1 pg.
(Continued)

*Primary Examiner* — Shane Bomar
(74) *Attorney, Agent, or Firm* — Chamberlain Hrdlicka

(57) ABSTRACT

Various embodiments disclosed relate to a fracture network model for simulating treatment of subterranean formations. In various embodiments, the present invention provides a method of simulating treatment of a subterranean formation. The method includes flowing a proppant slurry composition including proppant into each of one or more inlets of a fracture network model. The fracture network model includes a solid medium including a channel network, the one or more inlets, and one or more outlets. The channel network is free of fluidic connections leading outside of the solid medium other than the one or more inlets and the one or more outlets. The channel network includes a primary channel fluidly connected to each of the one or more inlets. The channel network also includes at least one secondary channel and fluidly connected to the primary channel, with the primary channel having a channel cross-section with a greater area than an area of a channel cross-section of the secondary channel. The method also includes detecting a placement pattern of the proppant from the proppant slurry composition in the channel network.

20 Claims, 3 Drawing Sheets

(56) References Cited

U.S. PATENT DOCUMENTS

| | | | | |
|---|---|---|---|---|
| 9,133,701 | B2 * | 9/2015 | Luharuka | E21B 43/267 |
| 2015/0212232 | A1 | 7/2015 | Perkins et al. | |

OTHER PUBLICATIONS

Norris, M. R., et al., "Multiple Proppant Fracturing of Horizontal Wellbores in a Chalk Formation:", *SPE Drilling & Completion*, (Mar. 2001), 48-59.

Schmidt, Darren, et al., "Performance of Mixed Proppant Sizes", SPE-168629, *SPE Hydraulic Fracturing Technology Conference*, Feb. 4-6, The Woodlands, Texas, USA, (2014), 1-10.

* cited by examiner

FRACTURE NETWORK MODEL FOR SIMULATING TREATMENT OF SUBTERRANEAN FORMATIONS

BACKGROUND

Proppant can be placed downhole during a hydraulic fracturing procedure to help hold fractures open, enhance fracture conductivity, and increase production. However, the fracture networks formed from hydraulic fracturing can be complex, and determining what size or combination of sizes of proppant to use for optimal proppant placement throughout the fracture network can be difficult. While computer models are available to estimate placement patterns of proppants in complex fracture networks, the models take time to set up and run and do not always give an accurate prediction of proppant placement in the actual fracture network.

BRIEF DESCRIPTION OF THE FIGURES

The drawings illustrate generally, by way of example, but not by way of limitation, various embodiments discussed in the present document.

DETAILED DESCRIPTION OF THE INVENTION

Figure 1:
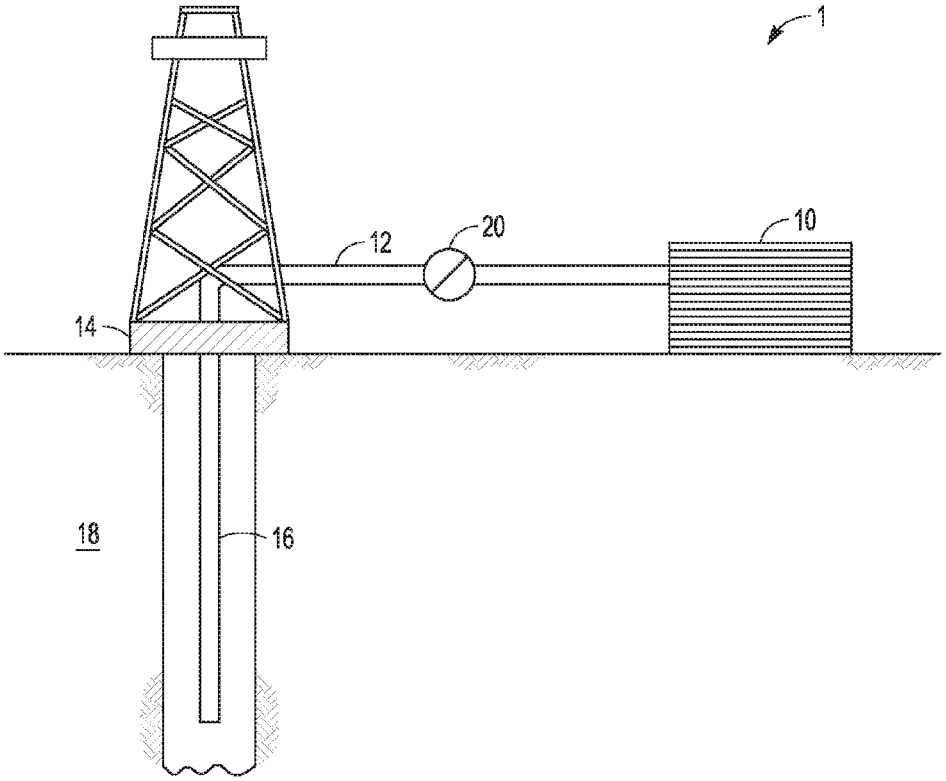
FIG. 1 illustrates a system or apparatus for delivering a composition to a subterranean formation, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

In this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an." or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein, the term "polymer" refers to a molecule having at least one repeating unit and can include copolymers.

The term "downhole" as used herein refers to under the surface of the earth, such as a location within or fluidly connected to a wellbore.

As used herein, the term "stimulation fluid" refers to fluids or slurries used downhole during stimulation activities of the well that can increase the production of a well, including perforation activities. In some examples, a stimulation fluid can include a fracturing fluid or an acidizing fluid.

As used herein, the term "fracturing fluid" refers to fluids or slurries used downhole during fracturing operations.

As used herein, the term "acidizing fluid" refers to fluids or slurries used downhole during acidizing treatments. In one example, an acidizing fluid is used in a clean-up operation to remove material obstructing the flow of desired material, such as material formed during a perforation operation. In some examples, an acidizing fluid can be used for damage removal.

As used herein, the term "fluid" refers to liquids and gels, unless otherwise indicated.

As used herein, the term "subterranean material" or "subterranean formation" refers to any material under the surface of the earth, including under the surface of the bottom of the ocean. For example, a subterranean formation or material can be any section of a wellbore and any section of a subterranean petroleum- or water-producing formation or region in fluid contact with the wellbore. Placing a material in a subterranean formation can include contacting the material with any section of a wellbore or with any subterranean region in fluid contact therewith. Subterranean materials can include any materials placed into the wellbore such as cement, drill shafts, liners, tubing, casing, or screens; placing a material in a subterranean formation can include contacting with such subterranean materials. In some examples, a subterranean formation or material can be any below-ground region that can produce liquid or gaseous petroleum materials, water, or any section below-ground in fluid contact therewith. For example, a subterranean formation or material can be at least one of an area desired to be fractured, a fracture or an area surrounding a fracture, and a flow pathway or an area surrounding a flow pathway, wherein a fracture or a flow pathway can be optionally fluidly connected to a subterranean petroleum- or water-producing region, directly or through one or more fractures or flow pathways.

As used herein, "treatment of a subterranean formation" can include any activity directed to extraction of water or petroleum materials from a subterranean petroleum- or water-producing formation or region, for example, including drilling, stimulation, hydraulic fracturing, clean-up, acidizing, completion, cementing, remedial treatment, abandonment, and the like.

As used herein, a "flow pathway" downhole can include any suitable subterranean flow pathway through which two subterranean locations are in fluid connection. The flow pathway can be sufficient for petroleum or water to flow from one subterranean location to the wellbore or vice-versa. A flow pathway can include at least one of a hydraulic fracture, and a fluid connection across a screen, across gravel pack, across proppant, including across resin-bonded proppant or proppant deposited in a fracture, and across sand. A flow pathway can include a natural subterranean passageway through which fluids can flow. In some embodiments, a flow pathway can be a water source and can include water. In some embodiments, a flow pathway can be a petroleum source and can include petroleum. In some embodiments, a flow pathway can be sufficient to divert from a wellbore, fracture, or flow pathway connected thereto at least one of water, a downhole fluid, or a produced hydrocarbon.

In various embodiments, the present invention provides a method of simulating treatment of a subterranean formation. The method includes flowing a proppant slurry composition including proppant into each one or more inlets of a fracture network model. The fracture network model includes a solid medium including a channel network, the one or more inlets, and one or more outlets, wherein the channel network is free of fluidic connections leading outside of the solid medium other than the one or more inlets and the one or more outlets. The channel network includes a primary channel fluidly connected to each of the one or more inlets. The channel network also includes at least one secondary channel fluidly connected to the primary channel, with the primary channel having a channel cross-section with a greater area than an area of a channel cross-section of the secondary channel. The method also includes detecting a placement pattern of the proppant from the proppant slurry composition in the channel network.

In various embodiments, the present invention provides a method of treatment of a subterranean formation. The method includes flowing a proppant slurry composition including proppant into each one or more inlets of a fracture network model. The fracture network model includes a transparent solid medium including a channel network, the one or more inlets, and one or more outlets, wherein the channel network is free of fluidic connections leading outside of the transparent medium other than the one or more inlets and the one or more outlets. The channel network includes a primary channel fluidly connected to the one or more inlets, wherein substantially all of the primary channel has an identical cross-section with a largest dimension of about 1 nm to about 10 mm. The channel network also includes at least one secondary channel and fluidly connected to the primary channel, wherein substantially all of the secondary channel has an identical cross-section with a largest dimension of about 1 nm to about 0.1 mm. The primary channel has a channel cross-section with a greater area than an area of a channel cross-section of the secondary channel. The method includes detecting a placement pattern of the proppant from the proppant slurry composition in the channel network. The method includes placing in the subterranean formation including a fracture network corresponding to the channel network in the fracture network model a second proppant slurry composition having a substantially identical concentration and size distribution of proppant as the proppant slurry composition flowed into the fracture network model.

In various embodiments, the present invention provides a system for simulating treatment of a subterranean formation. The system includes a fracture network model including a solid medium including a channel network, one or more inlets, and one or more outlets. The channel network is free of fluidic connections leading outside of the solid medium other than the one or more inlets and the one or more outlets. The channel network includes a primary channel fluidly connected to each of the one or more inlets. The channel network also includes at least one secondary channel fluidly connected to the primary channel, with the primary channel having a channel cross-section with a greater area than an area of a channel cross-section of the secondary channel. The system includes a proppant slurry composition including proppant. The system also includes a pump configured to flow the proppant slurry composition into the channel network and to deposit the proppant in the channel network in an observable placement pattern.

In various embodiments, the present invention provides a fracture network model for simulating treatment of a subterranean formation. The fracture network model includes a solid transparent medium including a channel network, one or more inlets, and one or more outlets. The channel network is free of fluidic connections leading outside of the transparent medium other than the one or more inlets and the one or more outlets. The channel network includes a primary channel fluidly connected to each of the one or more inlets, wherein substantially all of the primary channel has an identical cross-section. The channel network includes at least one secondary channel fluidly connected to the primary channel, wherein substantially all of the secondary channel has an identical cross-section, with the primary channel having a channel cross-section with a greater area than an area of a channel cross-section of the secondary channel.

In various embodiments, the present invention has certain advantages over other simulations and methods of subterranean treatment, at least some of which are unexpected. For example, in various embodiments, the method of simulating treatment of a subterranean formation of the present invention is faster or more accurate than running a computer model. In various embodiments, the method of simulating treatment of a subterranean formation of the present invention can be used to verify or supplement results of a computer model.

In various embodiments, the method of simulating treatment of a subterranean formation of the present invention can be used to enhance proppant placement throughout a fracture network more effectively than other simulation methods. In various embodiments, the method of simulating treatment of a subterranean formation of the present invention can be used to enhance production more effectively than other simulation methods. In various embodiments, by at least partially optimizing a ratio of a larger-sized proppant to a smaller-sized proppant for enhanced placement in the fracture network the present invention can enable less larger-sized proppant (e.g., macroproppant) and water to be used during a hydraulic fracturing procedure to provide a particular production rate, thereby saving costs. In various embodiments, the smaller-sized proppant (e.g., microproppant or nanoproppant) can keep the fractures open and can increase the overall conductivity of the fracture network as compared to other stimulation methods.

Method of Simulating Treatment of a Subterranean Formation.

In various embodiments, the present invention provides a method of simulating treatment of a subterranean formation. The method can include flowing a proppant slurry composition including proppant into each one or more inlets of a fracture network model. The fracture network model can include a solid medium including a channel network, the one or more inlets, and one or more outlets. The channel network can be free of fluidic connections leading outside of the solid medium other than the one or more inlets and the one or more outlets. The channel network can include a primary channel fluidly connected to each of the one or more inlets, and at least one secondary channel fluidly connected to the primary channel. The primary channel can have a channel cross-section with a greater area than an area of a channel cross-section of the secondary channel. The method can also include detecting a placement pattern of the proppant from the proppant slurry composition in the channel network in the fracture network model.

The detecting of the placement pattern of the proppant from the proppant slurry composition in the channel network in the fracture network model can be performed in any suitable way. In embodiments wherein the solid medium is at least partially transparent, the detecting can include optically observing the placement pattern, such as by eye or using electronic optical detection sensors or other equipment. The method can include using the placement pattern from the proppant slurry in the channel network in the fracture network model to verify or supplement results of another model that simulates the treatment of the subterranean formation, such as a computer model (e.g., a computation fluid dynamic (CFD) simulation).

The method can include at least partially optimizing the placement pattern of the proppant in the channel network in the fracture network model. Optimizing the placement pattern of the proppant in the channel network can include determining for the proppant slurry a combination of proppant sizes, a size distribution of proppant sizes, a proppant concentration, a flow rate, or a combination thereof, to produce a placement pattern wherein proppant is evenly distributed throughout the channel network. The method can include performing the method multiple times using different conditions to improve the proppant placement pattern. For example, performing the method multiple times can include using different proppant slurry compositions (e.g., with different sizes of proppant, different densities of proppant, different size distribution of proppant, different concentrations of proppant, or combinations thereof), different flow rates of the proppant slurry composition, or a combination thereof, to determine an at least partially optimized proppant slurry composition, an at least partially optimized flow rate, or a combination thereof. The method can include flowing a first proppant slurry composition into each one of the one or more inlets of the fracture network model, detecting the placement pattern of the proppant, clearing the proppant out of the fracture network model, and repeating the method using the first proppant slurry composition at a different flow rate or using a second proppant slurry composition including, as compared to the first proppant slurry, a proppant having a different particle size, a different distribution of proppant particle size, a different amount of proppant, or a combination thereof.

The proppant slurry composition can be any suitable proppant slurry that can be used in a subterranean hydraulic fracturing procedure. The proppant slurry composition includes a proppant (e.g., one type of proppant, or multiple types of proppant) and a carrier medium. The carrier medium can include any one or more fluids. For example, the fluid can be at least one of crude oil, dipropylene glycol methyl ether, dipropylene glycol dimethyl ether, dipropylene glycol methyl ether, dipropylene glycol dimethyl ether, dimethyl formamide, diethylene glycol methyl ether, ethylene glycol butyl ether, diethylene glycol butyl ether, butylglycidyl ether, propylene carbonate, D-limonene, a $C_2$-$C_{40}$ fatty acid $C_1$-$C_{10}$ alkyl ester (e.g., a fatty acid methyl ester), tetrahydrofurfuryl methacrylate, tetrahydrofurfuryl acrylate, 2-butoxy ethanol butyl acetate, butyl lactate, furfuryl acetate, dimethyl sulfoxide, dimethyl formamide, a petroleum distillation product of fraction (e.g., diesel, kerosene, napthas, and the like) mineral oil, a hydrocarbon oil, a hydrocarbon including an aromatic carbon-carbon bond (e.g., benzene, toluene), a hydrocarbon including an alpha olefin, xylenes, an ionic liquid, methyl ethyl ketone, an ester of oxalic, maleic or succinic acid, methanol, ethanol, propanol (iso- or normal-), butyl alcohol (iso-, tert-, or normal-), an aliphatic hydrocarbon (e.g., cyclohexanone, hexane), water, brine, produced water, flowback water, brackish water, and sea water. The carrier fluid can form about 30 wt % to about 99.999 wt % of the proppant slurry composition, or about 80 wt % to about 99.999 wt %, or about 30 wt % or less, or less than, equal to, or greater than about 30 wt %, 35, 40, 45, 50, 55, 60, 65, 70, 75, 80, 85, 90, 95, 96, 97, 98, 99, 99.9, 99.99, or about 99.999 wt % or more.

The proppant slurry composition includes proppant. The proppant can be one proppant or more than one proppant. The proppant slurry composition can include one size of proppant or multiple sizes of proppant. The proppant can be an uncoated proppant or a resin-coated proppant. A proppant is a material that keeps an induced hydraulic fracture at least partially open during or after a fracturing treatment. Proppants can be transported into the subterranean formation (e.g., downhole) to the fracture using fluid, such as fracturing fluid or another fluid. A higher-viscosity fluid can more effectively transport proppants to a desired location in a fracture, especially larger proppants, by more effectively keeping proppants in a suspended state within the fluid. Examples of proppants can include sand, gravel, glass beads, polymer beads, ground products from shells and seeds such as walnut hulls, and manmade materials such as ceramic proppant, bauxite, tetrafluoroethylene materials (e.g. TEFLON™ polytetrafluoroethylene), fruit pit materials, processed wood, composite particulates prepared from a binder and fine grade particulates such as silica, alumina, fumed silica, carbon black, graphite, mica, titanium dioxide, meta-silicate, calcium silicate, kaolin, talc, zirconia, boron, fly ash, formation cuttings (e.g., reinjected), hollow glass microspheres, and solid glass, or mixtures thereof. In some embodiments, the proppant can have an average particle size, wherein particle size is the largest dimension of a particle, of about 0.001 mm to about 3 mm, about 0.15 mm to about 2.5 mm, about 0.25 mm to about 0.43 mm, about 0.43 mm to about 0.85 mm, about 0.0001 mm to about 3 mm, about 0.015 mm to about 2.5 mm, about 0.025 mm to about 0.43 mm, about 0.043 mm to about 0.85 mm, about 0.085 mm to about 1.18 mm, about 0.85 mm to about 1.18 mm, about 1.18 mm to about 1.70 mm, or about 1.70 to about 2.36 mm. In some embodiments, the proppant can have a distribution of particle sizes clustering around multiple averages, such as one, two, three, or four different average particle sizes. The proppant slurry composition can include any suitable amount of proppant, such as about 0.001 wt % to about 70 wt %, about 0.001 wt % to about 20 wt %, about 0.1 wt % to about 50 wt %, or about 0.001 wt % or less, or less than, equal to, or greater than about 0.1 wt %, 1, 2, 3, 4, 5, 10, 15, 20, 30, 40, 50, 60, or about 70 wt % or more.

The proppant in the proppant slurry can include a first proppant. The first proppant can include a largest dimension of about 1 nm to about 10 mm, about 1 nm to about 100 microns, about 1 micron to about 10 mm, about 1 micron to about 500 microns, about 1 micron to about 100 microns, about 1 micron to about 50 microns, about 1 micron to about 10 microns, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

The method can include flowing a plurality of different proppants into the fracture network model sequentially or in parallel. For an in parallel embodiment, the proppant slurry includes different proppants. For a sequential embodiment, multiple proppant slurries can be flowed into the fracture network model sequentially, and the detecting of the placement pattern can include detecting the placement pattern of each of the multiple types of proppants from each of the proppant slurries flowed into the model. For example, after flowing the first proppant slurry into the fracture network model, the method can include flowing a second proppant slurry composition into each of the one or more inlets of the fracture network model, with the second proppant slurry including a second proppant having a composition, a largest dimension, or a combination thereof, that is different from that of the first proppant. Detecting the placement pattern can include detecting the placement pattern of the second proppant in the channel network in the fracture network model as well as the first proppant. In some embodiments, the second proppant can have a smaller largest dimension than the first proppant; in other embodiments, the second proppant can have a bigger largest dimension than the first proppant. A sequential embodiment can include flowing a third proppant slurry or any number of proppant slurries into the fracture network model, such as 4, 5, 6, 7, 8, 9, or 10 or more.

In addition to the first proppant, the proppant slurry can further include a second proppant having a composition, a largest dimension, or a combination thereof, that is different from that of the first proppant. The second proppant can have a larger or smaller largest dimension than the first proppant. The second proppant can have a largest dimension of about 1 nm to about 10 mm, about 1 micron to about 10 mm, about 1 micron to about 500 microns, about 1 micron to about 100 microns, about 1 micron to about 50 microns, about 1 nm to about 1,500 microns, about 200 microns to about 600 microns, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

In addition to the second proppant, the proppant slurry can further include a third proppant having a composition, a largest dimension, or a combination thereof, that is different from that of the first and second proppant. The third proppant can have a larger or smaller largest dimension than the first and second proppant. The third proppant can have a largest dimension of about 1 nm to about 10 mm, about 1 micron to about 10 mm, about 1 micron to about 500 microns, about 1 micron to about 100 microns, about 1 micron to about 50 microns, about 1 nm to about 2,000 microns, about 300 microns to about 1,000 microns, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

The method can include flowing a proppant slurry composition including proppant into each one or more inlets of a fracture network model. The fracture network model can include a solid medium including a channel network, the one or more inlets, and one or more outlets. The solid medium can be any solid medium such that the method can be carried out as described herein. The solid medium can be plastic (e.g., polymer), mineral (e.g., silicon, silicon oxide, quartz), glass, or metal. The solid medium can be an at least partially transparent solid medium, such as permitting optical detection of the placement pattern of the proppant in the channel network, such as permitting about 0.001% to about 100% of visual light to pass therethrough, or about 10% to about 100%, about 50% to about 100%, or about 0.001% or less, or less than, equal to, or greater than about 0.01%, 0.1, 1, 2, 3, 4, 5, 6, 8, 10, 15, 20, 30, 40, 50, 60, 70, 80, 90, 95, 96, 97, 98, 99, 99.9, 99.99, or about 99.999% or more of visual light to pass therethrough. The solid medium can be a substantially transparent medium.

The solid medium including the channel network can be any suitable shape, such that the method can be carried out as described herein. In various embodiments, the solid medium is a flat plate having the channel network therein. The solid medium can be a combination of two flat plates that have been etched with the channel network (e.g., one plate can be etched (e.g., via laser or acid) with the full network, or both plates can be etched with a fraction of the channel network such as one half of the channel network), the one or more inlets, and the one or more outlets, and subsequently fused together to form the solid medium including the channel network. In some embodiments, the method can include etching the solid medium to form the channel network therein. The method can include etching at least one section of the solid medium and adhering the etched section to another section of the solid medium to form the solid medium including the channel network. The solid medium including the channel network can be a microfluidic device (e.g., can be free of flow paths larger than about 1 mm). The solid medium including the channel network can be a microfluidic chip or panel, such as can be provided by the Singapore Institute of Manufacturing Technology (SIMTech).

The channel network in the fracture network model can be free of channels having a channel cross-section (e.g., a section of the channel taken transverse to the longitudinal direction of the channel) with a largest dimension equal to or larger than 100 mm, equal to or larger than 50 mm, equal to or larger than 10 mm, equal to or larger than 5 mm, equal to or larger than 1 mm, or equal to or larger than 0.1 mm. The channel network can be free of channels having a channel cross-section with a largest dimension larger than 100 mm, 75, 50, 40, 30, 20, 10, 5, 4, 3, 2, 1 mm, 900 microns, 800, 700, 600, 500, 450, 400, 350, 300, 250, 200, 175, 150, 125, 110, 100, 90, 80, 70, 60, 50, 45, 40, 35, 30, 25, 20, 15, 10, 5, 4, 3, 2, 1 micron, 900 nm, 800, 700, 600, 500, 450, 400, 350, 300, 250, 200, 175, 150, 125, 110, 100, 90, 80, 70, 60, 50, 45, 40, 35, 30, 25, 20, 15, 10, 5, 4, 3, 2 nm, or about 1 nm or less.

The channel network in the fracture network model can be free of fluidic connections leading outside of the solid medium other than the one or more inlets and the one or more outlets. The channel network can include one or more inlets, wherein a primary channel is fluidly connected (e.g., fluid can flow from the entrance of the inlet into the primary channel) to each of the one or more inlets. The one or more inlets can be physically connected to a channel (e.g., the inlet can be on or adjacent to the channel), such as the primary channel, the secondary channel, or a tertiary channel. The channel network can include at least one secondary channel fluidly connected to the primary channel. The secondary channel can be physically connected to the primary channel (e.g., the secondary channel can be on or adjacent to the primary channel), another secondary channel, a tertiary channel, or a combination thereof. The primary channel can have a channel cross-section with a greater area than an area of a channel cross-section of the secondary channel.

The channel network in the fracture network model can include one primary channel or more than one primary channel. In various embodiments, substantially all of the primary channel has an identical cross-section. For example, substantially all of the primary channel can have a channel cross-section that has about the same largest dimension, area, shape, or a combination thereof. The primary channel can have a channel cross-section with a largest dimension of about 1 nm to about 10 mm, about 1 micron to about 10 mm, about 1 micron to about 5 mm, about 1 micron to about 500 microns, about 1 micron to about 100 microns, about 1 micron to about 50 microns, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

The channel network in the fracture network model can include one secondary channel or more than one secondary channel. In various embodiments, substantially all of the one or more secondary channels can independently have an identical cross-section. For example, substantially all of the secondary channel can have a channel cross-section that has about the same largest dimension, area, shape, or a combination thereof. The secondary channel can have a channel cross-section with a largest dimension of about 1 nm to about 10 mm, about 1 micron to about 10 mm, about 1 nm to about 0.1 mm, about 1 micron to about 500 microns, about 1 micron to about 100 microns, about 1 micron to about 50 microns, about 0.1 microns to about 0.05 mm, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

The solid medium includes at least one inlet fluidly connected to the primary channel. The inlet can be physically connected to the primary channel the secondary channel, a tertiary channel, or another channel. The solid medium can include more than one inlet fluidly connected to the primary channel. The solid medium includes at least one outlet to allow fluid to exit the channel network. The one or more outlets can be independently located at any suitable position on the channel network, such as fluidly connected to the primary channel, the secondary channel, or fluidly connected to any one or more suitable channels in the channel network. The one or more outlets can be independently physically connected to the primary channel, the secondary channel, a tertiary channel or another channel. In some embodiments, at least some of the one or more outlets are fluidly (and, optionally, physically) connected to the smallest channels in the channel network, such as the secondary channels, tertiary channels (if present), or smaller channels.

The channel network in the fracture network model can include at least one tertiary channel fluidly connected to the primary and secondary channel. The tertiary channel can be physically connected to the primary channel, the secondary channel, another tertiary channel, another channel, or a combination thereof. The secondary channel can have a channel cross-section with a greater area than an area of a channel cross-section of the tertiary channel. For example, substantially all of the tertiary channel can have a channel cross-section that has about the same largest dimension, area, shape, or a combination thereof. The tertiary channel can have a channel cross-section with a largest dimension of about 1 nm to about 10 mm, about 1 nm to about 10 microns, about 1 micron to about 10 mm, about 1 micron to about 500 microns, about 1 micron to about 100 microns, about 1 micron to about 50 microns, about 0.1 microns to about 2 microns, or about 1 nm or less, or less than, equal to, or greater than about 2 nm, 3, 4, 5, 6, 8, 10, 12, 14, 16, 18, 20, 25, 50, 75, 100, 150, 200, 250, 500, 750 nm, 1 micron, 2 microns, 3, 4, 5, 6, 8, 10, 12, 14, 16, 18, 20, 25, 30, 35, 40, 45, 50, 55, 60, 65, 70, 75, 80, 85, 90, 95, 100, 110, 120, 150, 175, 200, 250, 300, 350, 400, 450, 500, 600, 700, 800, 900 microns, 1 mm, 2, 3, 4, 5, 6, 7, 8, 9, or about 10 mm or more.

Treatment of a Subterranean Formation.

In various embodiments, the present invention includes treating a subterranean formation with a proppant slurry composition. The method can include treating the subterranean formation with the proppant slurry composition that was flowed into the fracture network model, or with a second proppant slurry composition having a substantially identical concentration and size distribution of proppant as the proppant slurry composition flowed into the fracture network model.

The method can include fracturing the subterranean formation to form a fracture network that substantially corresponds to the channel network in the solid medium of the fracture network model. The fracture network in the subterranean formation can be formed before or after obtaining or providing the solid medium with the channel network therein. The method can include placing the proppant slurry composition in the subterranean formation, such that the proppant in the proppant slurry composition is placed in the formed fracture network.

In some embodiments, before placing a proppant slurry composition in the subterranean formation, the method can include at least partially optimizing the placement pattern of the proppant in the channel network in the fracture network model by performing the method multiple times using different proppant slurry compositions, different flow rates of the proppant slurry composition, or a combination thereof, to determine an at least partially optimized proppant slurry composition, an at least partially optimized flow rate, or a combination thereof. The method can include contacting a subterranean formation with the at least partially optimized proppant slurry composition, the at least partially optimized flow rate (of a proppant slurry composition), or a combination thereof.

In some embodiments, the proppant slurry composition can be placed in the subterranean formation neat. In some embodiments, the proppant slurry composition can be placed in the subterranean formation as a component of another composition. For example, a subterranean treatment fluid can include the proppant slurry composition, wherein the subterranean treatment fluid is a stimulation fluid, a hydraulic fracturing fluid, a drilling fluid, a spotting fluid, a clean-up fluid, a completion fluid, a remedial treatment fluid, an abandonment fluid, a pill, an acidizing fluid, a cementing fluid, a packer fluid, a logging fluid, or a combination thereof. The placing of the composition in the subterranean formation can including placing the subterranean treatment fluid that includes the proppant slurry composition in the subterranean formation. The method can include performing a subterranean formation treatment operation in the subterranean formation, such as using the subterranean treatment fluid that includes the proppant slurry composition, or using a subterranean treatment fluid that is free of the proppant slurry composition but with placement of the proppant slurry composition in the subterranean formation before or after placing the subterranean treatment fluid in the subterranean formation. The method can include hydraulic fracturing, stimulation, drilling, spotting, clean-up, completion, remedial treatment, abandonment, acidizing, cementing, packing, logging, or a combination thereof. The subterranean treatment fluid can be a hydraulic fracturing fluid. The method can include hydraulically fracturing the subterranean formation with the proppant slurry composition (e.g., which can be injected as or adjacent to a hydraulic fracturing fluid) or with a hydraulic fracturing fluid including the proppant slurry composition.

The method can include obtaining or providing the proppant slurry composition above-surface, such as wherein one or more components of the proppant slurry composition are mixed together above-surface to form the proppant slurry composition. The method can include subsequently placing the proppant slurry composition formed above-surface in the subterranean formation. The method can include obtaining or providing the proppant slurry composition in the subterranean formation, such as wherein one or more components of the proppant slurry composition are mixed together in the subterranean formation to form the composition. When the proppant slurry composition is obtained or provided in the subterranean formation, the formation of the proppant slurry composition in the subterranean formation can be placing the composition in the subterranean formation (e.g., the moment the proppant slurry composition has been created in the subterranean formation, it has also been placed there).

The placing of the proppant slurry composition in the subterranean formation and the contacting of the subterranean formation and the proppant slurry composition can occur at any time with respect to one another; for example, the hydraulic fracturing can occur at least one of before, during, and after the contacting or placing. In some embodiments, the contacting or placing occurs during the hydraulic fracturing, such as during any suitable stage of the hydraulic fracturing, such as during at least one of a pre-pad stage (e.g., during injection of water with no proppant, and additionally optionally mid- to low-strength acid), a pad stage (e.g., during injection of fluid only with no proppant, with some viscosifier, such as to begin to break into an area and initiate fractures to produce sufficient penetration and width to allow proppant-laden later stages to enter), or a slurry stage of the fracturing (e.g., viscous fluid with proppant). The method can include performing a stimulation treatment at least one of before, during, and after placing the proppant slurry composition in the subterranean formation in the fracture, flow pathway, or area surrounding the same. The stimulation treatment can be, for example, at least one of perforating, acidizing, injecting of cleaning fluids, propellant stimulation, and hydraulic fracturing. In some embodiments, the stimulation treatment at least partially generates a fracture or flow pathway where the proppant slurry composition is placed in or contacted to, or the proppant slurry composition is placed in or contacted to an area surrounding the generated fracture or flow pathway.

Other Components.

The proppant slurry composition (e.g., that is flowed into the fracture network model, that is placed in the subterranean formation, or a combination thereof) can include any suitable additional component in any suitable proportion, such that the proppant slurry composition can be used as described herein. Any component listed in this section can be present or not present in the proppant slurry composition.

In some embodiments, the proppant slurry composition includes one or more viscosifiers. The viscosifier can be any suitable viscosifier. The viscosifier can affect the viscosity of the proppant slurry composition or a solvent that contacts the proppant slurry composition at any suitable time and location. In some embodiments, the viscosifier provides an increased viscosity at least one of before injection into the subterranean formation, at the time of injection into the subterranean formation, during travel through a tubular disposed in a borehole, once the proppant slurry composition reaches a particular subterranean location, or some period of time after the proppant slurry composition reaches a particular subterranean location. In some embodiments, the viscosifier can be about 0.000, 1 wt % to about 10 wt % of the proppant slurry composition, about 0.004 wt % to about 0.01 wt %, or about 0.000.1 wt % or less, or less than, equal to, or greater than about 0.000,5 wt %, 0.001, 0.005, 0.01, 0.05, 0.1, 0.5, 1, 2, 3, 4, 5, 6, 7, 8, 9, or about 10 wt % or more of the proppant slurry composition.

The viscosifier can include at least one of a substituted or unsubstituted polysaccharide, and a substituted or unsubstituted polyalkene (e.g., a polyethylene, wherein the ethylene unit is substituted or unsubstituted, derived from the corresponding substituted or unsubstituted ethene), wherein the polysaccharide or polyalkene is crosslinked or uncrosslinked. The viscosifier can include a polymer including at least one repeating unit derived from a monomer selected from the group consisting of ethylene glycol acrylamide, vinyl acetate, 2-acrylamidomethylpropane sulfonic acid or its salts, trimethylammoniumethyl acrylate halide, and trimethylammoniumethyl methacrylate halide. The viscosifier can include a crosslinked gel or a crosslinkable gel. The viscosifier can include at least one of a linear polysaccharide, and a poly(($C_2$-$C_{10}$)alkene), wherein the ($C_2$-$C_{10}$) alkene is substituted or unsubstituted. The viscosifier can include at least one of poly(acrylic acid) or ($C_1$-$C_5$)alkyl esters thereof, poly(methacrylic acid) or ($C_1$-$C_5$)alkyl esters thereof, poly(vinyl acetate), poly(vinyl alcohol), poly(ethylene glycol), poly(vinyl pyrrolidone), polyacrylamide, poly (hydroxyethyl methacrylate), alginate, chitosan, curdlan, dextran, derivatized dextran, emulsan, a galactoglucopolysaccharide, gellan, glucuronan, N-acetyl-glucosamine, N-acetyl-heparosan, hyaluronic acid, kefiran, lentinan, levan, mauran, pullulan, scleroglucan, schizophyllan, stewartan, succinoglycan, xanthan, diutan, welan, starch, derivatized starch, tamarind, tragacanth, guar gum, derivatized guar gum (e.g., hydroxypropyl guar, carboxy methyl guar, or carboxymethyl hydroxypropyl guar), gum ghatti, gum arabic, locust bean gum, karaya gum, cellulose, and derivatized cellulose (e.g., carboxymethyl cellulose, hydroxyethyl cellulose, carboxymethyl hydroxyethyl cellulose, hydroxypropyl cellulose, or methyl hydroxy ethyl cellulose).

In some embodiments, the viscosifier can include at least one of a poly(vinyl alcohol) homopolymer, poly(vinyl alcohol) copolymer, a crosslinked poly(vinyl alcohol) homopolymer, and a crosslinked poly(vinyl alcohol) copolymer. The viscosifier can include a poly(vinyl alcohol) copolymer or a crosslinked poly(vinyl alcohol) copolymer including at least one of a graft, linear, branched, block, and random copolymer of vinyl alcohol and at least one of a substituted or unsubstituted ($C_2$-$C_{50}$)hydrocarbyl having at least one aliphatic unsaturated C—C bond therein, and a substituted or unsubstituted ($C_2$-$C_{50}$)alkene. The viscosifier can include a poly(vinyl alcohol) copolymer or a crosslinked poly(vinyl alcohol) copolymer including at least one of a graft, linear, branched, block, and random copolymer of vinyl alcohol and at least one of vinyl phosphonic acid, vinylidene diphosphonic acid, substituted or unsubstituted 2-acrylamido-2-methylpropanesulfonic acid, a substituted or unsubstituted ($C_1$-$C_{20}$)alkenoic acid, propenoic acid, butenoic acid, pentenoic acid, hexenoic acid, octenoic acid, nonenoic acid, decenoic acid, acrylic acid, methacrylic acid, hydroxypropyl acrylic acid, acrylamide, fumaric acid, methacrylic acid, hydroxypropyl acrylic acid, vinyl phosphonic acid, vinylidene diphosphonic acid, itaconic acid, crotonic acid, mesoconic acid, citraconic acid, styrene sulfonic acid, allyl sulfonic acid, methallyl sulfonic acid, vinyl sulfonic acid, and a substituted or unsubstituted ($C_1$-$C_{20}$)alkyl ester thereof. The viscosifier can include a poly(vinyl alcohol) copolymer or a crosslinked poly(vinyl alcohol) copolymer including at least one of a graft, linear, branched, block, and random copolymer of vinyl alcohol and at least one of vinyl acetate, vinyl propanoate, vinyl butanoate, vinyl pentanoate, vinyl hexanoate, vinyl 2-methyl butanoate, vinyl 3-ethylpentanoate, vinyl 3-ethylhexanoate, maleic anhydride, a substituted or unsubstituted ($C_1$-$C_{20}$)alkenoic substituted or unsubstituted ($C_1$-$C_{20}$)alkanoic anhydride, a substituted or unsubstituted ($C_1$-$C_{20}$)alkenoic substituted or unsubstituted ($C_1$-$C_{20}$)alkenoic anhydride, propenoic acid anhydride, butenoic acid anhydride, pentenoic acid anhydride, hexenoic acid anhydride, octenoic acid anhydride, nonenoic acid anhydride, decenoic acid anhydride, acrylic acid anhydride, fumaric acid anhydride, methacrylic acid anhydride, hydroxypropyl acrylic acid anhydride, vinyl phosphonic acid anhydride, vinylidene diphosphonic acid anhydride, itaconic acid anhydride, crotonic acid anhydride, mesoconic acid anhydride, citraconic acid anhydride, styrene sulfonic acid anhydride, allyl sulfonic acid anhydride, methallyl sulfonic acid anhydride, vinyl sulfonic acid anhydride, and an N—($C_1$-$C_{10}$)alkenyl nitrogen-containing substituted or unsubstituted ($C_1$-$C_{10}$)heterocycle. The viscosifier can include a poly(vinyl alcohol) copolymer or a crosslinked poly(vinyl alcohol) copolymer including at least one of a graft, linear, branched, block, and random copolymer that includes a poly(vinylalcohol/acrylamide) copolymer, a poly (vinylalcohol/2-acrylamido-2-methylpropanesulfonic acid) copolymer, a poly (acrylamide/2-acrylamido-2-methylpropanesulfonic acid) copolymer, or a poly(vinylalcohol/N-vinylpyrrolidone) copolymer. The viscosifier can include a crosslinked poly(vinyl alcohol) homopolymer or copolymer including a crosslinker including at least one of chromium, aluminum, antimony, zirconium, titanium, calcium, boron, iron, silicon, copper, zinc, magnesium, and an ion thereof. The viscosifier can include a crosslinked poly(vinyl alcohol) homopolymer or copolymer including a crosslinker including at least one of an aldehyde, an aldehyde-forming compound, a carboxylic acid or an ester thereof, a sulfonic acid or an ester thereof, a phosphonic acid or an ester thereof, an acid anhydride, and an epihalohydrin.

In various embodiments, the proppant slurry composition can include one or more crosslinkers. The crosslinker can be any suitable crosslinker. In some examples, the crosslinker can be incorporated in a crosslinked viscosifier, and in other examples, the crosslinker can crosslink a crosslinkable material (e.g., downhole). The crosslinker can include at least one of chromium, aluminum, antimony, zirconium, titanium, calcium, boron, iron, silicon, copper, zinc, magnesium, and an ion thereof. The crosslinker can include at least one of boric acid, borax, a borate, a ($C_1$-$C_{30}$)hydrocarbylboronic acid, a ($C_1$-$C_{30}$)hydrocarbyl ester of a ($C_1$-$C_{30}$)hydrocarbylboronic acid, a ($C_1$-$C_{30}$)hydrocarbylboronic acid-modified polyacrylamide, ferric chloride, disodium octaborate tetrahydrate, sodium metaborate, sodium diborate, sodium tetraborate, disodium tetraborate, a pentaborate, ulexite, colemanite, magnesium oxide, zirconium lactate, zirconium triethanol amine, zirconium lactate triethanolamine, zirconium carbonate, zirconium acetylacetonate, zirconium malate, zirconium citrate, zirconium diisopropylamine lactate, zirconium glycolate, zirconium triethanol amine glycolate, zirconium lactate glycolate, titanium lactate, titanium malate, titanium citrate, titanium ammonium lactate, titanium triethanolamine, titanium acetylacetonate, aluminum lactate, and aluminum citrate. In some embodiments, the crosslinker can be a ($C_1$-$C_{20}$)alkylenebiacrylamide (e.g., methylenebisacrylamide), a poly (($C_1$-$C_{20}$)alkenyl)-substituted mono- or poly-($C_1$-$C_{20}$)alkyl ether (e.g., pentaerythritol allyl ether), and a poly($C_2$-$C_{20}$) alkenylbenzene (e.g., divinylbenzene). In some embodiments, the crosslinker can be at least one of alkyl diacrylate, ethylene glycol diacrylate, ethylene glycol dimethacrylate, polyethylene glycol diacrylate, polyethylene glycol dimethacrylate, ethoxylated bisphenol A diacrylate, ethoxylated bisphenol A dimethacrylate, ethoxylated trimethylol propane triacrylate, ethoxylated trimethylol propane trimethacrylate, ethoxylated glyceryl triacrylate, ethoxylated glyceryl trimethacrylate, ethoxylated pentaerythritol tetraacrylate, ethoxylated pentaerythritol tetramethacrylate, ethoxylated dipentaerythritol hexaacrylate, polyglyceryl monoethylene oxide polyacrylate, polyglyceryl polyethylene glycol polyacrylate, dipentaerythritol hexaacrylate, dipentaerythritol hexamethacrylate, neopentyl glycol diacrylate, neopentyl glycol dimethacrylate, pentaerythritol triacrylate, pentaerythritol trimethacrylate, trimethylol propane triacrylate, trimethylol propane trimethacrylate, tricyclodecane dimethanol diacrylate, tricyclodecane dimethanol dimethacrylate, 1,6-hexanediol diacrylate, and 1,6-hexanediol dimethacrylate. The crosslinker can be about 0.000,01 wt % to about 5 wt % of the proppant slurry composition, about 0.001 wt % to about 0.01 wt %, or about 0.000,01 wt % or less, or less than, equal to, or greater than about 0.000,05 wt %, 0.000,1, 0.000,5, 0.001, 0.005, 0.01, 0.05, 0.1, 0.5, 1, 2, 3, 4, or about 5 wt % or more.

In some embodiments, the proppant slurry composition can include one or more breakers. The breaker can be any suitable breaker, such that the surrounding fluid (e.g., a fracturing fluid) can be at least partially broken for more complete and more efficient recovery thereof, such as at the conclusion of the hydraulic fracturing treatment. In some embodiments, the breaker can be encapsulated or otherwise formulated to give a delayed-release or a time-release of the breaker, such that the surrounding liquid can remain viscous for a suitable amount of time prior to breaking. The breaker can be any suitable breaker; for example, the breaker can be a compound that includes at least one of a $Na^+$, $K^+$, $Li^+$, $Zn^+$, $NH_4^+$, $Fe^{2+}$, $Fe^{3+}$, $Cu^{1+}$, $Cu^{2+}$, $Ca^{2+}$, $Mg^{2+}$, $Zn^{2+}$, and an $Al^{3+}$ salt of a chloride, fluoride, bromide, phosphate, or sulfate ion. In some examples, the breaker can be an oxidative breaker or an enzymatic breaker. An oxidative breaker can be at least one of a $Na^+$, $K^+$, $Li^+$, $Zn^+$, $NH_4^+$, $Fe^{2+}$, $Fe^{3+}$, $Cu^{1+}$, $Cu^{2+}$, $Ca^{2+}$, $Mg^{2+}$, $Zn^{2+}$, and an $Al^{3+}$ salt of a persulfate, percarbonate, perborate, peroxide, perphosphosphate, permanganate, chlorite, or hypochlorite ion. An enzymatic breaker can be at least one of an alpha or beta amylase, amyloglucosidase, oligoglucosidase, invertase, maltase, cellulase, hemi-cellulase, and mannanohydrolase. The breaker can be about 0.001 wt % to about 30 wt % of the proppant slurry composition, or about 0.01 wt % to about 5 wt %, or about 0.001 wt % or less, or less than, equal to, or greater than about 0.005 wt %, 0.01, 0.05, 0.1, 0.5, 1, 2, 3, 4, 5, 6, 8, 10, 12, 14, 16, 18, 20, 22, 24, 26, 28, or about 30 wt % or more.

In some embodiments, the proppant slurry composition can include any suitable amount of any suitable material used in a downhole fluid. For example, the proppant slurry composition can include water, saline, aqueous base, acid, oil, organic solvent, synthetic fluid oil phase, aqueous solution, alcohol or polyol, cellulose, starch, alkalinity control agents, acidity control agents, density control agents, density modifiers, emulsifiers, dispersants, polymeric stabilizers, polyacrylamide, a polymer or combination of polymers, antioxidants, heat stabilizers, foam control agents, solvents, diluents, plasticizer, filler or inorganic particle, pigment, dye, precipitating agent, oil-wetting agents, set retarding additives, surfactants, gases, weight reducing additives, heavy-weight additives, lost circulation materials, filtration control additives, salts (e.g., any suitable salt, such as potassium salts such as potassium chloride, potassium bromide, potassium formate; calcium salts such as calcium chloride, calcium bromide, calcium formate; cesium salts such as cesium chloride, cesium bromide, cesium formate, or a combination thereof), fibers, thixotropic additives, breakers, crosslinkers, rheology modifiers, curing accelerators, curing retarders, pH modifiers, chelating agents, scale inhibitors, enzymes, resins, water control materials, oxidizers, markers, Portland cement, pozzolana cement, gypsum cement, high alumina content cement, slag cement, silica cement, fly ash, metakaolin, shale, zeolite, a crystalline silica compound, amorphous silica, hydratable clays, microspheres, lime, or a combination thereof. In various embodiments, the proppant slurry composition can include one or more additive components such as COLDTROL®, ATC®, OMC 2™, and OMC 42™ thinner additives; RHEMOD™ viscosifier and suspension agent; TEMPERUS™ and VIS-PLUS® additives for providing temporary increased viscosity; TAU-MOD™ viscosifying/suspension agent; ADAPTA®, DURATONE® HT, THERMO TONE™, BDF™-366, and BDF™-454 filtration control agents; LIQUITONE™ polymeric filtration agent and viscosifier; FACTANT™ emulsion stabilizer; LE SUPERMUL™, EZ MUL® NT, and FORTI-MUL® emulsifiers; DRIL TREAT® oil wetting agent for heavy fluids; AQUATONE-S™ wetting agent; BARACARB® bridging agent; BAROID® weighting agent; BAROLIFT® hole sweeping agent; SWEEP-WATE® sweep weighting agent; BDF-508 rheology modifier; and GELTONE® II organophilic clay. Any suitable proportion of the proppant slurry composition can include any optional component listed in this paragraph, such as about 0.001 wt % to about 99.999 wt %, about 0.01 wt % to about 99.99 wt %, about 0.1 wt % to about 99.9 wt %, about 20 to about 90 wt %, or about 0.001 wt % or less, or less than, equal to, or greater than about 0.01 wt %, 0.1, 1, 2, 3, 4, 5, 10, 15, 20, 30, 40, 50, 60, 70, 80, 85, 90, 91, 92, 93, 94, 95, 96, 97, 98, 99, 99.9, 99.99 wt %, or about 99.999 wt % or more of the proppant slurry composition.

System or Apparatus.

In various embodiments, the present invention provides a system for simulating treatment of a subterranean formation. The system can be any suitable system that can perform an embodiment of the method for simulating treatment of a subterranean formation described herein. The system can include a fracture network model including a solid medium including a channel network, one or more inlets, and one or more outlets. The channel network can be free of fluidic connections leading outside of the solid medium other than the one or more inlets and the one or more outlets. The channel network includes a primary channel fluidly connected to each of the one or more inlets. The channel network can include at least one secondary channel fluidly connected to the primary channel. The primary channel can have a channel cross-section with a greater area than an area of a channel cross-section of the secondary channel. The system can include a proppant slurry composition including proppant. The system can include a pump configured to flow the proppant slurry composition into the channel network and to deposit the proppant in the channel network in an observable placement pattern.

In some embodiments, the system can further include a tubular (e.g., any suitable type of oilfield pipe, such as pipeline, drill pipe, production tubing, and the like) disposed in the subterranean formation. The system can also include a second pump configured to pump a second proppant slurry composition through the tubular in the subterranean formation. The second proppant slurry composition can include a substantially identical concentration and size distribution of proppant as the proppant slurry composition flowed into the fracture network model. The second pump can be fluidly connected to the tubular.

The pump for pumping the second proppant slurry composition into the fracture network model can be any suitable pump. The second pump can be a high pressure pump in some embodiments. As used herein, the term "high pressure pump" will refer to a pump that is capable of delivering a fluid to a subterranean formation (e.g., downhole) at a pressure of about 1000 psi or greater. A high pressure pump can be used when it is desired to introduce the proppant slurry composition to a subterranean formation at or above a fracture gradient of the subterranean formation, but it can also be used in cases where fracturing is not desired. In some embodiments, the high pressure pump can be capable of fluidly conveying particulate matter, such as proppant particulates, into the subterranean formation. Suitable high pressure pumps will be known to one having ordinary skill in the art and can include floating piston pumps and positive displacement pumps.

In other embodiments, the second pump can be a low pressure pump. As used herein, the term "low pressure pump" will refer to a pump that operates at a pressure of about 1000 psi or less. In some embodiments, a low pressure pump can be fluidly coupled to a high pressure pump that is fluidly coupled to the tubular. That is, in such embodiments, the low pressure pump can be configured to convey the proppant slurry composition to the high pressure pump. In such embodiments, the low pressure pump can "step up" the pressure of the proppant slurry composition before it reaches the high pressure pump.

In some embodiments, the systems or apparatuses described herein can further include a mixing tank that is upstream of the second pump and in which the proppant slurry composition is formulated. In various embodiments, the second pump (e.g., a low pressure pump, a high pressure pump, or a combination thereof) can convey the proppant slurry composition from the mixing tank or other source of the proppant slurry composition to the tubular. In other embodiments, however, the proppant slurry composition can be formulated offsite and transported to a worksite, in which case the proppant slurry composition can be introduced to the tubular via the pump directly from its shipping container (e.g., a truck, a railcar, a barge, or the like) or from a transport pipeline. In either case, the proppant slurry composition can be drawn into the second pump, elevated to an appropriate pressure, and then introduced into the tubular for delivery to the subterranean formation.

FIG. 1 shows an illustrative schematic of systems and apparatuses that can deliver embodiments of the proppant slurry compositions of the present invention to a subterranean location, according to one or more embodiments. It should be noted that while FIG. 1 generally depicts a land-based system or apparatus, it is to be recognized that like systems and apparatuses can be operated in subsea locations as well. Embodiments of the present invention can have a different scale than that depicted in FIG. 1. As depicted in FIG. 1, system or apparatus 1 can include mixing tank 10, in which an embodiment of the proppant slurry composition can be formulated. The composition can be conveyed via line 12 to wellhead 14, where the composition enters tubular 16, with tubular 16 extending from wellhead 14 into subterranean formation 18. Upon being ejected from tubular 16, the composition can subsequently penetrate into subterranean formation 18. Second pump 20 can be configured to raise the pressure of the composition to a desired degree before its introduction into tubular 16. It is to be recognized that system or apparatus 1 is merely exemplary in nature and various additional components can be present that have not necessarily been depicted in FIG. 1 in the interest of clarity. In some examples, additional components that can be present include supply hoppers, valves, condensers, adapters, joints, gauges, sensors, compressors, pressure controllers, pressure sensors, flow rate controllers, flow rate sensors, temperature sensors, and the like.

Although not depicted in FIG. 1, at least part of the proppant slurry composition can, in some embodiments, flow back to wellhead 14 and exit subterranean formation 18. In some embodiments, the composition that has flowed back to wellhead 14 can subsequently be recovered, and in some examples reformulated, and recirculated to subterranean formation 18.

It is also to be recognized that the disclosed proppant slurry composition can also directly or indirectly affect the various downhole or subterranean equipment and tools that can come into contact with the composition during operation. Such equipment and tools can include wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the systems and apparatus generally described above and depicted in FIG. 1.

Fracture Network Model.

In various embodiments, the present invention provides a fracture network model for simulating treatment of a subterranean formation. The fracture network model can be any suitable fracture network model that can be used to perform an embodiment of the method of simulating treatment of a subterranean formation described herein. For example, the fracture network model can include a solid transparent medium including a channel network, one or more inlets, and one or more outlets. The channel network can be free of fluidic connections leading outside of the transparent medium other than the one or more inlets and the one or more outlets. The channel network can include a primary channel fluidly connected to each of the one or more inlets, wherein substantially all of the primary channel can have an identical cross-section. The channel network can include at least one secondary channel fluidly connected to the primary channel, wherein substantially all of the secondary channel can have an identical cross-section. The primary channel can have a channel cross-section with a greater area than an area of a channel cross-section of the secondary channel.

Figure 3:
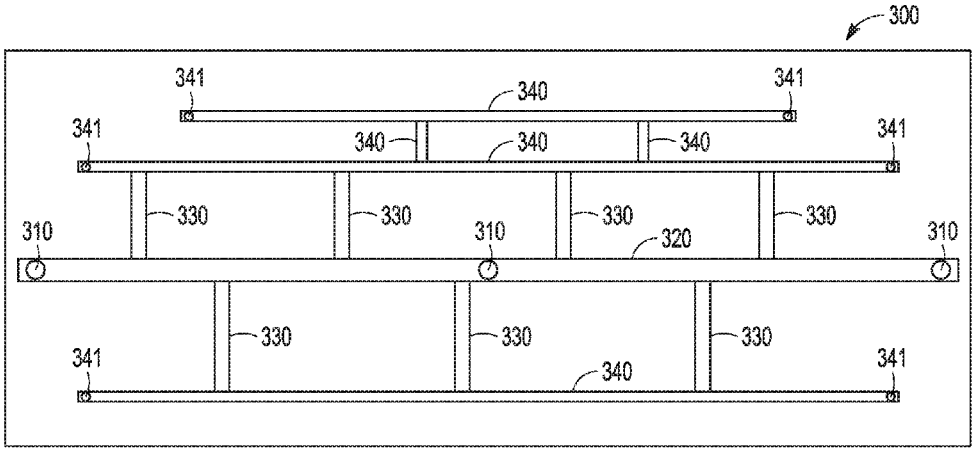
FIG. 3 illustrates a physical model of a fracture network, according to various embodiments.

FIG. 3 illustrates a fracture network model 300, having physically and fluidly connected to inlets 310 a primary channel 320, several secondary channels 330 therein fluidly and physically connected to the primary channel 320, and several tertiary channels 340 therein fluidly and physically connected to the secondary channels. An outlet 341 is located at the end of each tertiary channel.

Figure 4:
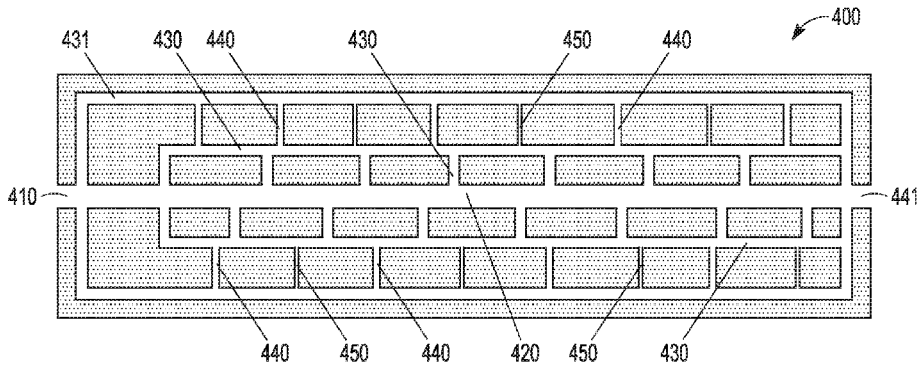
FIG. 4 illustrates a physical model of a fracture network, according to various embodiments.

FIG. 4 illustrates a fracture network model 400, having fluidly connected to inlet 410 a primary channel 420, several secondary channels 430 and 431 fluidly connected to the primary channel 420, several tertiary channels 440 fluidly connected to the primary channel 420, and several quaternary channels 450 fluidly connected to the primary channel 420. An outlet 441 is fluidly connected to the primary channel. The primary channel 410 has a width of 100 microns, the secondary channels 430 have a width of 40 microns, the secondary channels 431 have a width of 50 microns, the tertiary channels 440 have a width of 25 microns, and the quaternary channels 450 have a width of 10 microns. The inlet 410 and the outlet 441 have the same width as the primary channel.

Figure 5:
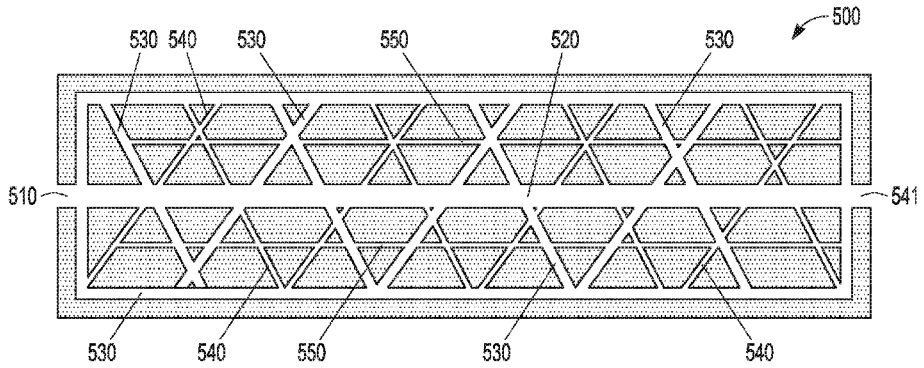
FIG. 5 illustrates a physical model of a fracture network, according to various embodiments.

FIG. 5 illustrates a fracture network model 500, having fluidly connect to inlet 510 a primary channel 520, several secondary channels 530 fluidly connected to the primary channel 520, several tertiary channels 540 fluidly connected to the primary channel 520, and several quaternary channels 550 fluidly connected to the primary channel 520. An outlet 541 is fluidly connected to the primary channel. The primary channel 520 has a width of 100 microns, the secondary channels 530 have a width of 50 microns, the tertiary channels 540 have a width of 30 microns, and the quaternary channels have a width of 20 microns.

Examples

Various embodiments of the present invention can be better understood by reference to the following Examples, which are offered by way of illustration. The present invention is not limited to the Examples given herein.

Example 1. Computer Model

Figure 2:
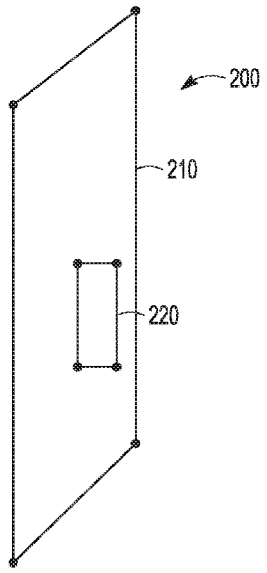
FIG. 2 illustrates a primary and secondary fracture in a computer simulation, in accordance with various embodiments.

Three dimensional (3D)-flow modeling was performed using COMSOL Multiphysics®, a simulation tool that can be used for fluid flow applications. A simple fracture system geometry 200 as shown in FIG. 2 was constructed in the simulator, including a primary fracture 210 with a rectangular cross-section having a width of 10 mm and a height and length of 1 m with a smaller secondary fracture 220 with a rectangular cross-section having a width of 6 mm, a height of 0.25 m, and a length of 0.1 m, approximately centered on the primary fracture and orthogonal thereto. The fracture system was oriented such that both the primary and secondary fracture were parallel to the direction of the force of gravity, with proppant entering the primary fracture at the top of the fracture system.

Spherical particles of two sizes, 50 microns and 500 microns, were used for the simulation. The carrier fluid used was water, with no viscosifiers therein. The concentration of each proppant was 0.3 vol %. The 500 micron particles were pumped for 10 seconds and subsequently the 50 micron particles were pumped for 90 seconds. Fluid drag was also included in the simulation. The inlet velocity was 1 m/s, with a volumetric flow rate of 0.01 $m^3$/sec. The simulation time was 100 seconds. The 50 micron particles flowed to the secondary fractures but the 500 micron particles only flowed through the primary fracture and also showed gravitational settling in the primary fracture.

Example 2. Physical Model (Hypothetical)

A transparent glass thin plate was obtained having connected to an inlet a primary channel therein having a square cross-section with a 10 mm width and a secondary channel therein having a square cross-section with a 6 mm width that extends from the primary channel. During the simulation, the primary channel was oriented parallel to the force of gravity, the secondary channel was oriented perpendicular to the force of gravity, and proppant entered the primary channel through the inlet at the top of the primary channel. An outlet was located at the end of the secondary channel. Spherical particles of two sizes, 50 microns and 500 microns, were used for the simulation. The carrier fluid used was water, with no viscosifiers therein. The concentration of each proppant was 0.3 vol %. The 500 micron particles were pumped for 10 seconds and subsequently the 50 micron particles were pumped for 90 seconds. The inlet velocity was 1 m/s, with a volumetric flow rate of 0.01 $m^3$/sec.

The physical model confirmed the results of the computer model, with the larger proppant only entering the primary channel and settling in the primary channel due to gravity, and with the smaller proppant entering the secondary channel.

Example 3. Physical Model (Hypothetical)

A transparent glass thin plate 300 was obtained as shown in FIG. 3, having connected to a inlets 310 a primary channel 320 therein having a round cross-section with a size of 6 mm, several secondary channels 330 therein having a round cross-section extending from the primary channel 320 and having a size of 4 mm, and several tertiary channels 340 therein having a round cross-section extending from the secondary channels and having a size of 2 mm. An outlet 341 was located at the end of each tertiary channel.

A flow rate of 0.01 $m^3$/sec was used. A small-sized microproppant having a diameter of 5 microns was used, and a large-sized microproppant having a diameter between 30-40 microns was used. The concentration of each proppant was 0.3 vol %. The small-sized proppant was pumped for about 10 seconds, and then the large-sized proppant was pumped for about 90 seconds.

During the simulation, the small sized micro-proppant was placed in the secondary and tertiary fractures, while the large-sized micro-proppant accumulated and formed proppant nodes at the entrances of the secondary fractures.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments

The following exemplary embodiments are provided, the numbering of which is not to be construed as designating levels of importance:

Embodiment 1 provides a method of simulating treatment of a subterranean formation, the method comprising:

flowing a proppant slurry composition comprising proppant into each of one or more inlets of a fracture network model, the fracture network model comprising a solid medium comprising a channel network, the one or more inlets, and one or more outlets, wherein the channel network is free of fluidic connections leading outside of the solid medium other than the one or more inlets and the one or more outlets, the channel network comprising a primary channel fluidly connected to each of the one or more inlets, and at least one secondary channel fluidly connected to the primary channel, the primary channel having a channel cross-section with a greater area than an area of a channel cross-section of the secondary channel; and detecting a placement pattern of the proppant from the proppant slurry composition in the channel network.

Embodiment 2 provides the method of Embodiment 1, wherein the solid medium is a substantially transparent medium.

Embodiment 3 provides the method of Embodiment 2, wherein detecting the placement pattern of the proppant from the proppant slurry composition in the channel network comprises optically observing the placement pattern of the proppant.

Embodiment 4 provides the method of any one of Embodiments 1-3, further comprising at least partially optimizing the placement pattern of the proppant in the channel network by performing the method multiple times using different proppant slurry compositions, different flow rates of the proppant slurry composition, or a combination thereof, to determine an at least partially optimized proppant slurry composition, an at least partially optimized flow rate, or a combination thereof.

Embodiment 5 provides the method of any one of Embodiments 1-4, wherein the proppant slurry composition is a first proppant slurry composition, further comprising repeating the method using the first proppant slurry at a different flow rate or using a second proppant slurry composition comprising, as compared to the first proppant slurry, a proppant having a different particle size, a different distribution of proppant particle size, a different amount of proppant, or a combination thereof.

Embodiment 6 provides the method of any one of Embodiments 1-5, wherein the placement pattern of the proppant from the proppant slurry in the channel network is used to verify or supplement the results of a computer model that simulates the treatment of the subterranean formation.

Embodiment 7 provides the method of any one of Embodiments 1-6, further comprising placing in the subterranean formation a second proppant slurry composition having an identical concentration and size distribution of proppant as the proppant slurry composition flowed into the fracture network model.

Embodiment 8 provides the method of any one of Embodiments 1-7, further comprising placing the proppant slurry composition in the subterranean formation.

Embodiment 9 provides the method of any one of Embodiments 1-8, further comprising fracturing the subterranean formation to form a fracture network that substantially corresponds to the channel network, and further comprising placing the proppant slurry composition in the subterranean formation.

Embodiment 10 provides the method of any one of Embodiments 1-9, further comprising at least partially optimizing the placement pattern of the proppant in the channel network by performing the method multiple times using different proppant slurry compositions, different flow rates of the proppant slurry composition, or a combination thereof, to determine an at least partially optimized proppant slurry composition, an at least partially optimized flow rate, or a combination thereof, further comprising contacting a subterranean formation with the at least partially optimized proppant slurry composition, the at least partially optimized flow rate, or a combination thereof.

Embodiment 11 provides the method of any one of Embodiments 1-10, wherein the proppant slurry comprises a carrier medium that comprises water.

Embodiment 12 provides the method of any one of Embodiments 1-11, wherein the proppant slurry is about 80 wt % to about 99.999 wt % water.

Embodiment 13 provides the method of any one of Embodiments 1-12, wherein the proppant is about 0.001 wt % to about 20 wt % of the proppant slurry.

Embodiment 14 provides the method of any one of Embodiments 1-13, wherein the solid medium comprising the channel network is a microfluidic device.

Embodiment 15 provides the method of any one of Embodiments 1-14, wherein the solid medium comprising the channel network is a microfluidic chip or panel.

Embodiment 16 provides the method of any one of Embodiments 1-15, further comprising etching the solid medium to form the channel network therein.

Embodiment 17 provides the method of any one of Embodiments 1-16, further comprising etching at least one section of the solid medium and adhering the etched section to another section of the solid medium to form the solid medium comprising the channel network.

Embodiment 18 provides the method of any one of Embodiments 1-17, wherein the channel network is free of channels having a channel cross-section with a largest dimension equal to or larger than about 10 mm.

Embodiment 19 provides the method of any one of Embodiments 1-18, wherein the channel network is free of channels having a channel cross-section with a largest dimension equal to or larger than about 5 mm.

Embodiment 20 provides the method of any one of Embodiments 1-19, wherein the channel network is free of channels having a channel cross-section with a largest dimension equal to or larger than about 0.1 mm.

Embodiment 21 provides the method of any one of Embodiments 1-20, wherein substantially all of the primary channel has an identical cross-section.

Embodiment 22 provides the method of any one of Embodiments 1-21, wherein the primary channel has a channel cross-section with a largest dimension of about 1 nm to about 10 mm.

Embodiment 23 provides the method of any one of Embodiments 1-22, wherein the primary channel has a channel cross-section with a largest dimension of about 1 micron to about 5 mm.

Embodiment 24 provides the method of any one of Embodiments 1-23, wherein substantially all of the secondary channel has an identical cross-section.

Embodiment 25 provides the method of any one of Embodiments 1-24, wherein the secondary channel has a channel cross-section with a largest dimension of about 1 nm to about 0.1 mm.

Embodiment 26 provides the method of any one of Embodiments 1-25, wherein the secondary channel has a channel cross-section with a largest dimension of about 0.1 micron to about 0.05 mm.

Embodiment 27 provides the method of any one of Embodiments 1-26, wherein the proppant in the proppant slurry comprises a first proppant.

Embodiment 28 provides the method of Embodiment 27, wherein the first proppant has a largest dimension of about 1 nm to about 100 microns.

Embodiment 29 provides the method of any one of Embodiments 27-28, wherein the first proppant has a largest dimension of about 1 micron to about 10 microns.

Embodiment 30 provides the method of any one of Embodiments 27-29, further comprising flowing a second proppant slurry composition comprising proppant into each of the one or more inlets of the fracture network model, the second proppant slurry comprising a second proppant having a composition, a largest dimension, or a combination thereof, that is different from that of the first proppant, wherein detecting the placement pattern further comprises detecting a placement pattern of the proppant from the second proppant slurry composition in the channel network.

Embodiment 31 provides the method of any one of Embodiments 27-30, wherein the proppant in the proppant slurry further comprises a second proppant having a composition, a largest dimension, or a combination thereof, that is different from that of the first and second proppant.

Embodiment 32 provides the method of Embodiment 31, wherein the second proppant has a larger largest dimension than the first proppant.

Embodiment 33 provides the method of any one of Embodiments 31-32, wherein the second proppant has a largest dimension of about 1 nm to about 1.500 microns.

Embodiment 34 provides the method of any one of Embodiments 31-33, wherein the second proppant has a largest dimension of about 200 micron to about 600 microns.

Embodiment 35 provides the method of any one of Embodiments 27-34, wherein the proppant in the proppant slurry further comprises a third proppant having a composition, a largest dimension, or a combination thereof, that is different from that of the first proppant.

Embodiment 36 provides the method of Embodiment 35, wherein the third proppant has a larger largest dimension than the second proppant.

Embodiment 37 provides the method of any one of Embodiments 35-36, wherein the third proppant has a largest dimension of about 1 nm to about 2,000 microns.

Embodiment 38 provides the method of any one of Embodiments 35-37, wherein the third proppant has a largest dimension of about 300 microns to about 1,000 microns.

Embodiment 39 provides the method of any one of Embodiments 1-38, wherein at least one of the one or more outlets is connected fluidly to the primary channel.

Embodiment 40 provides the method of any one of Embodiments 1-39, wherein at least one of the one or more outlets is connected fluidly to the secondary channel.

Embodiment 41 provides the method of any one of Embodiments 1-40, wherein the channel network further comprises at least one tertiary channel connected fluidly to at least one of the secondary channels.

Embodiment 42 provides the method of Embodiment 41, wherein substantially all of the tertiary channel has an identical cross-section.

Embodiment 43 provides the method of any one of Embodiments 41-42, wherein the tertiary channel has a channel cross-section with a largest dimension of about 1 nm to about 10 microns.

Embodiment 44 provides the method of any one of Embodiments 41-43, wherein the tertiary channel has a channel cross-section with a largest dimension of about 0.1 micron to about 2 microns.

Embodiment 45 provides the method of any one of Embodiments 41-44, wherein at least one of the one or more outlets is connected fluidly to the tertiary channel.

Embodiment 46 provides a system for performing the method of any one of Embodiments 1-45, the system comprising:

the fracture network model;

the proppant slurry composition; and a pump configured to perform the flowing of the proppant slurry composition into the fracture network model.

Embodiment 47 provides the system of Embodiment 46, further comprising a tubular disposed in the subterranean formation; and a pump configured to pump a second proppant slurry composition through the tubular in the subterranean formation, the second proppant slurry composition comprising a substantially identical concentration and size distribution of proppant as the proppant slurry composition flowed into the fracture network model.

Embodiment 48 provides a method of treating a subterranean formation, the method comprising:

flowing a proppant slurry composition comprising proppant into each of one or more inlets of a fracture network model, the fracture network model comprising a transparent solid medium comprising a channel network, the one or more inlets, and one or more outlets, wherein the channel network is free of fluidic connections leading outside of the transparent medium other than the one or more inlets and the one or more outlets, the channel network comprising a primary channel fluidly connected to the one or more inlets, wherein substantially all of the primary channel has an identical cross-section with a largest dimension of about 1 nm to about 10 mm, and at least one secondary channel fluidly connected to the primary channel, wherein substantially all of the secondary channel has an identical cross-section with a largest dimension of about 1 nm to about 0.1 mm, the primary channel having a channel cross-section with a greater area than an area of a channel cross-section of the secondary channel;

detecting a placement pattern of the proppant from the proppant slurry composition in the channel network; and placing in the subterranean formation comprising a fracture network corresponding to the channel network in the fracture network model a second proppant slurry composition having a substantially identical concentration and size distribution of proppant as the proppant slurry composition flowed into the fracture network model.

Embodiment 49 provides a system for simulating treatment of a subterranean formation, the system comprising:

a fracture network model comprising a solid medium comprising a channel network, one or more inlets, and one or more outlets, wherein the channel network is free of fluidic connections leading outside of the solid medium other than the one or more inlets and the one or more outlets, the channel network comprising a primary channel fluidly connected to each of the one or more inlets, and at least one secondary channel fluidly connected to the primary channel, the primary channel having a channel cross-section with a greater area than an area of a channel cross-section of the secondary channel;

a proppant slurry composition comprising proppant; and a pump configured to flow the proppant slurry composition into the channel network and to deposit the proppant in the channel network in an observable placement pattern.

Embodiment 50 provides a system for treatment of a subterranean formation, the system comprising:

the system of Embodiment 49;

a tubular disposed in the subterranean formation; and a second pump configured to pump a second proppant slurry composition through the tubular in the subterranean formation, the second proppant slurry composition comprising a substantially identical concentration and size distribution of proppant as the proppant slurry composition flowed into the fracture network model.

Embodiment 51 provides a fracture network model for simulating treatment of a subterranean formation, the fracture network model comprising:

a solid transparent medium comprising a channel network, one or more inlets, and one or more outlets, wherein the channel network is free of fluidic connections leading outside of the transparent medium other than the one or more inlets and the one or more outlets, the channel network comprising a primary channel fluidly connected to each of the one or more inlets, wherein substantially all of the primary channel has an identical cross-section, and at least one secondary channel fluidly connected to the primary channel, wherein substantially all of the secondary channel has an identical cross-section, the primary channel having a channel cross-section with a greater area than an area of a channel cross-section of the secondary channel.

Embodiment 52 provides the method, fracture network model, or system of any one or any combination of Embodiments 1-51 optionally configured such that all elements or options recited are available to use or select from.

What is claimed is:

1. A method of simulating treatment of a subterranean formation, the method comprising:

flowing a proppant slurry composition comprising proppant into each of one or more inlets of a fracture network model, the fracture network model comprising a solid medium comprising a channel network, the one or more inlets, and one or more outlets, wherein the channel network is free of fluidic connections leading outside of the solid medium other than the one or more inlets and the one or more outlets, the channel network comprising a primary channel fluidly connected to each of the one or more inlets, and at least one secondary channel fluidly connected to the primary channel, the primary channel having a channel cross-section with a greater area than an area of a channel cross-section of the secondary channel; and detecting a placement pattern of the proppant from the proppant slurry composition in the channel network.

2. The method of claim 1, wherein the solid medium is a substantially transparent medium.

3. The method of claim 2, wherein detecting the placement pattern of the proppant from the proppant slurry composition in the channel network comprises optically observing the placement pattern of the proppant.

4. The method of claim 1, further comprising at least partially optimizing the placement pattern of the proppant in the channel network by performing the method multiple times using different proppant slurry compositions, different flow rates of the proppant slurry composition, or a combination thereof, to determine an at least partially optimized proppant slurry composition, an at least partially optimized flow rate, or a combination thereof.

5. The method of claim 1, wherein the proppant slurry composition is a first proppant slurry composition, further comprising repeating the method using the first proppant slurry at a different flow rate or using a second proppant slurry composition comprising, as compared to the first proppant slurry, a proppant having a different particle size, a different distribution of proppant particle size, a different amount of proppant, or a combination thereof.

6. The method of claim 1, further comprising using the placement pattern of the proppant from the proppant slurry in the channel network to verify or supplement the results of a computer model that simulates the treatment of the subterranean formation.

7. The method of claim 1, further comprising at least partially optimizing the placement pattern of the proppant in the channel network by performing the method multiple times using different proppant slurry compositions, different flow rates of the proppant slurry composition, or a combination thereof, to determine an at least partially optimized proppant slurry composition, an at least partially optimized flow rate, or a combination thereof, further comprising contacting a subterranean formation comprising a fracture network that substantially corresponds to the channel network with the at least partially optimized proppant slurry composition, the at least partially optimized flow rate, or a combination thereof.

8. The method of claim 1, wherein the proppant slurry comprises a carrier medium that comprises water.

9. The method of claim 1, wherein the proppant is about 0.001 wt % to about 20 wt % of the proppant slurry.

10. The method of claim 1, wherein the solid medium comprising the channel network is a microfluidic device.

11. The method of claim 1, wherein the channel network is free of channels having a channel cross-section with a largest dimension equal to or larger than about 10 mm.

12. The method of claim 1, wherein the primary channel has a channel cross-section with a largest dimension of about 1 nm to about 10 mm.

13. The method of claim 1, wherein the secondary channel has a channel cross-section with a largest dimension of about 1 nm to about 0.1 mm.

14. The method of claim 1, wherein the proppant in the proppant slurry comprises a first proppant.

15. The method of claim 14, wherein the first proppant has a largest dimension of about 1 nm to about 100 microns.

16. The method of claim 14, further comprising flowing a second proppant slurry composition comprising proppant into each of the one or more inlets of the fracture network model, the second proppant slurry comprising a second proppant having a composition, a largest dimension, or a combination thereof, that is different from that of the first proppant, wherein detecting the placement pattern further comprises detecting a placement pattern of the proppant from the second proppant slurry composition in the channel network.

17. The method of claim 14, wherein the proppant in the proppant slurry further comprises a second proppant having a composition, a largest dimension, or a combination thereof, that is different from that of the first and second proppant.

18. A method of treating a subterranean formation, the method comprising:

flowing a proppant slurry composition comprising proppant into each of one or more inlets of a fracture network model, the fracture network model comprising a transparent solid medium comprising a channel network, the one or more inlets, and one or more outlets, wherein the channel network is free of fluidic connections leading outside of the transparent medium other than the one or more inlets and the one or more outlets, the channel network comprising a primary channel fluidly connected to the one or more inlets, wherein substantially all of the primary channel has an identical cross-section with a largest dimension of about 1 nm to about 10 mm, and at least one secondary channel fluidly connected to the primary channel, wherein substantially all of the secondary channel has an identical cross-section with a largest dimension of about 1 nm to about 0.1 mm, the primary channel having a channel cross-section with a greater area than an area of a channel cross-section of the secondary channel;

detecting a placement pattern of the proppant from the proppant slurry composition in the channel network; and placing in the subterranean formation comprising a fracture network corresponding to the channel network in the fracture network model a second proppant slurry composition having a substantially identical concentration and size distribution of proppant as the proppant slurry composition flowed into the fracture network model.

19. A system for simulating treatment of a subterranean formation, the system comprising:

a fracture network model comprising a solid medium comprising a channel network, one or more inlets, and one or more outlets, wherein the channel network is free of fluidic connections leading outside of the solid medium other than the one or more inlets and the one or more outlets, the channel network comprising a primary channel fluidly connected to each of the one or more inlets, and at least one secondary channel fluidly connected to the primary channel, the primary channel having a channel cross-section with a greater area than an area of a channel cross-section of the secondary channel;

a proppant slurry composition comprising proppant; and a pump configured to flow the proppant slurry composition into the channel network and to deposit the proppant in the channel network in an observable placement pattern.

20. A system for treatment of a subterranean formation, the system comprising:

the system of claim 19;

a tubular disposed in the subterranean formation; and a second pump configured to pump a second proppant slurry composition through the tubular in the subterranean formation, the second proppant slurry composition comprising a substantially identical concentration and size distribution of proppant as the proppant slurry composition flowed into the fracture network model.

* * * * *